US006843374B1

(12) United States Patent
Li et al.

(10) Patent No.: US 6,843,374 B1
(45) Date of Patent: Jan. 18, 2005

(54) BUFFER PACKING APPARATUS

(75) Inventors: Ming-Wei Li, Taipei (TW); Chia-Chen Yu, Taipei (TW)

(73) Assignee: Arima Computer Corporation, Taipei (TW)

( * ) Notice: Subject to any disclaimer, the term of this patent is extended or adjusted under 35 U.S.C. 154(b) by 0 days.

(21) Appl. No.: 10/605,347

(22) Filed: Sep. 24, 2003

(51) Int. Cl.[7] ..... B65D 81/02
(52) U.S. Cl. ..... 206/587; 206/59.1
(58) Field of Search ..... 206/320, 521–586, 206/588, 591, 592, 594, 453

(56) References Cited

U.S. PATENT DOCUMENTS 5,341,934 A * 8/1994 Hsu ..... 206/591
5,398,808 A * 3/1995 Chen et al. ..... 206/320
5,772,025 A * 6/1998 Chen et al. ..... 206/320
5,979,659 A * 11/1999 Kataoka ..... 206/591
6,257,412 B1 * 7/2001 Yamamoto et al. ..... 206/586
6,685,025 B1 * 2/2004 Kari ..... 206/592

* cited by examiner

*Primary Examiner*—Luan K. Bui
(74) *Attorney, Agent, or Firm*—Jiang Chyun IP Office

(57) ABSTRACT

A buffer packing apparatus for packing an object and increasing the buffering capacity between the object and a packaging box is provided. The buffer packing apparatus comprises a U-shaped column body and a pair of buffering sleeves. The two carrier boards in the U-shaped column body support the upper and lower surface of the object. The buffering sleeves are engaged to the respective ends of the U-shaped column body to form a buffering space for protecting the object against external impact. The corners of the buffer packing apparatus are also chamfered to increase the buffering capacity of buffering sleeves when the packaging box receives an external impact.

11 Claims, 5 Drawing Sheets

BUFFER PACKING APPARATUS

BACKGROUND OF INVENTION

1. Field of the Invention

The present invention relates to a buffer packing apparatus. More particularly, the present invention relates to an easy-to-assemble and flexible buffer packing apparatus.

2. Description of the Related Art

Most objects including notebook computers, CD-ROM or liquid crystal display (LCD) usually rely on a buffer packing apparatus to house the object inside a packaging box and provide buffering space for absorbing shock resulting from transportation. In the past, buffer packing apparatus frequently deployed polyurethane foam or emulsified polyethylene material because the material is light and easy to shape.

FIG. 1 is a perspective view of a buffer packing apparatus fabricated using polyurethane foam or emulsified polyethylene (EPE). The buffer packing apparatus 700 is slid into opposite sides of a packing object 702 for securing the object and providing some buffering. Since emulsified polyethylene is more flexible and bendable than polyurethane foam, more designs can be implemented using emulsified polyethylene. Moreover, a buffer packing apparatus fabricated using emulsified polyethylene has more buffering capacity than one fabricated using polyurethane foam.

In recent years, with the issue of environmental protection in everybody's mind, polyurethane foam or emulsified polyethylene material in packages is considered environmentally unfriendly. Consequently, the buffer packing apparatus is fabricated using a more environmentally friendly material including paper or paper-like substances. FIG. 2 is a perspective view of a conventional paper buffer packing apparatus. As shown in FIG. 2, the buffer packing apparatus 800 are slid into the opposite sides of a packing object 802 for housing the object and providing some buffering protection. The paper buffer packing apparatus is formed, for example, by pumping paper pulp into a mold and releasing the mold on solidification. However, mold development is often expensive thereby increasing the production cost of such designs. Moreover, one mold can produce a packing apparatus of only one size. Hence, the paper buffer packing apparatus often has quite limited use.

SUMMARY OF INVENTION

Accordingly, one object of the present invention is to provide a buffer packing apparatus for increasing the buffering effect between an object and a packaging box.

To achieve these and other advantages and in accordance with the purpose of the invention, as embodied and broadly described herein, the invention provides a buffer packing apparatus. The buffer packing apparatus at least comprises a U-shaped column body and two buffering sleeves. The U-shaped column body furthermore comprises a bumper plate, a pair of carrier boards and a pair of protruded sections. The carrier boards connect perpendicularly with the bumper plate. The ends of each carrier board have two first slots. The protruded sections connect with the respective ends of each carrier board. Each carrier board and its corresponding protruded sections are coplanar. The protruded sections extend from the two ends of the carrier board inwards and form a plurality of second slots in between. The buffering sleeves comprise a first meshing board, a second meshing board and a plurality of connecting boards. The meshing board has two third slots. The third slots on the first meshing board mesh with the first slots at one end of the carrier board. The second meshing board has two fourth slots. The fourth slots on the second meshing board mesh with the second slots between the protruded sections and the carrier boards. In addition, the connecting boards connect the first meshing board and the second meshing board.

According to one aspect of this invention, the corners of each protruded section close to the two sides of the carrier board are chamfered and each connecting board encloses the corners just outside the chamfers.

According to another aspect of this invention, the end of each second meshing board connects with a support plate. The support plate is located between the connecting board and the second meshing board for maintaining a distance of separation between the two.

According to another aspect of this invention, the two ends of the bumper plate in the U-shaped column body have two grooves. Furthermore, the end of board located between the third slots of each first meshing board branches out into a first plugging board and a second plugging board.

According to another aspect of this invention, the first plugging board is inserted into the groove and the second plugging board is bent around and attached to the bumper plate.

According to another aspect of this invention, the bumper board, the first meshing board and the carrier board all support the object when the object is enclosed inside the buffer packing apparatus.

According to another aspect of this invention, the buffer packing apparatus is fabricated using material including chevron paper, paper boards, paper-like boards or other types of buffering materials.

According to this invention, the buffer packing apparatus comprises a U-shaped column body and two buffering sleeves. The bumper plate and the first meshing board support and press against the four sides of a wrap object for housing the object on a horizontal plane. The distance separating the carrier boards is equal to the height of the object for supporting the object and limiting any movement of the object in the vertical direction. The buffering sleeves located at two ends of the U-shaped column body form a main buffering space for protecting the object against any damage resulting from an external impact. In addition, the chamfers on the buffering sleeves prevent a portion of the buffering sleeves from contacting the folded section of the packaging box. Hence, the buffering sleeves are prevented from a direct impact when any corner of the packaging box is hit. In other words, the buffer packing apparatus is strengthened structurally. In brief, the buffer packing apparatus of this invention not only has a simple apparatus but is also easy to fabricate. Moreover, the buffer packing apparatus can be easily modified to enclose objects having a different dimension. All that is required is simply to change the positions of the slots on the U-shaped column and adjust the width of the U-shaped column body.

It is to be understood that both the foregoing general description and the following detailed description are exemplary, and are intended to provide further explanation of the invention as claimed.

BRIEF DESCRIPTION OF DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION

Figure 1:
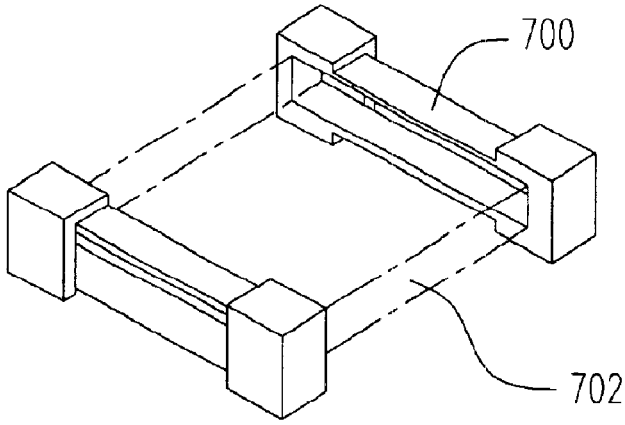
FIG. 1 (PRIOR ART)
FIG. 1 is a perspective view of a buffer packing apparatus fabricated using polyurethane foam or emulsified polyethylene (EPE).
Figure 2:
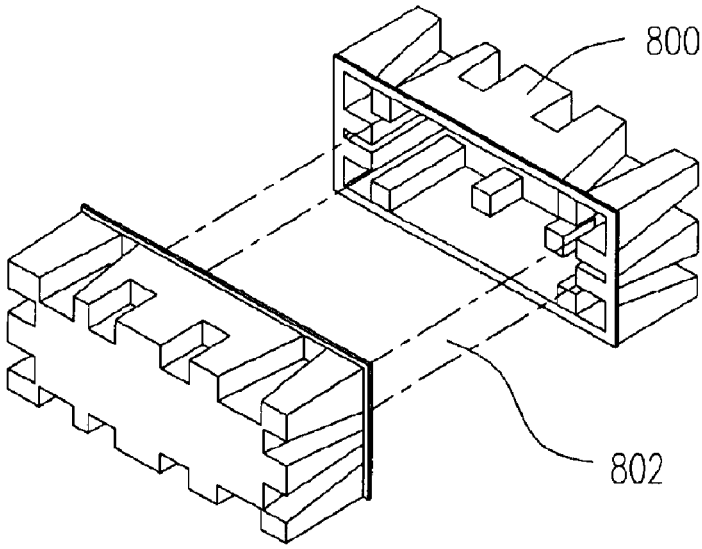
FIG. 2 (PRIOR ART)
FIG. 2 is a perspective view of a conventional paper buffer packing apparatus.

Reference will now be made in detail to the present preferred embodiments of the invention, examples of which are illustrated in the accompanying drawings. Wherever possible, the same reference numbers are used in the drawings and the description to refer to the same or like parts.

Figure 3:
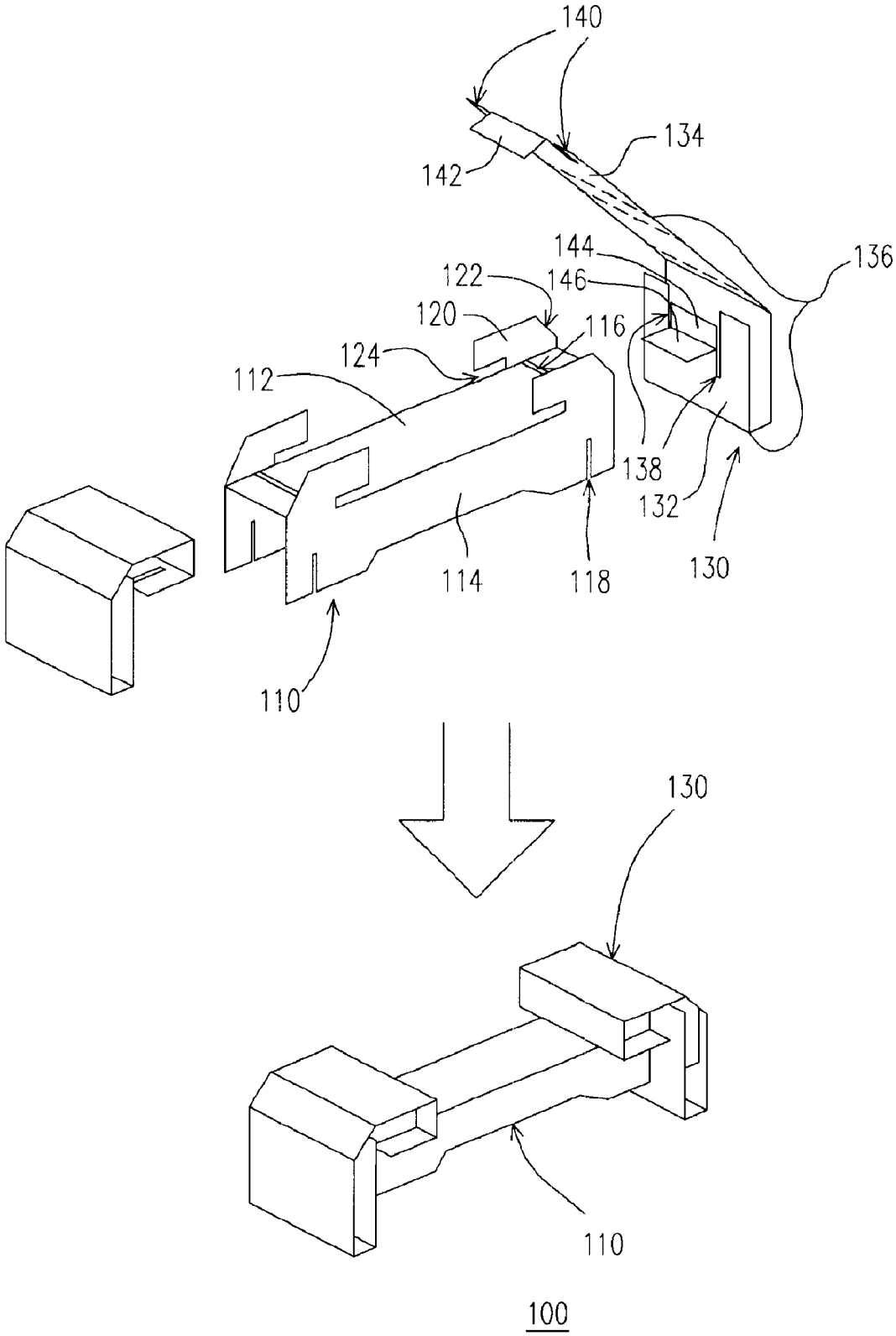
FIG. 3 is a perspective view showing the process of assembling a buffer packing apparatus according to this invention.

FIG. 3 is a perspective view showing the process of assembling a buffer packing apparatus according to this invention. The buffer packing apparatus 100 is fabricated using chevron paper, board paper or paper-like material, for example. As shown in FIG. 3, the buffer packing apparatus 100 comprises a U-shaped column body 110 and a pair of buffering sleeves 130. The U-shaped column body 110 furthermore comprises a bumper plate 112, a pair of carrier boards 114 and a pair of protruded sections 120. A groove 116 is extended between both ends of the bumper plate 112. The carrier boards 114 connect perpendicularly with the respective bumper plates 112. Furthermore, the ends of each carrier board 114 have a pair of first slots 118. The protruded sections 120 connect with the ends of each carrier board 114. Each carrier board 114 is coplanar with a corresponding protruded section 120. The protruded section 120 extending from the ends of each carrier board 114 inwards to form a pair of second slots 124 therebetween.

The buffering sleeves 130 comprises a first meshing board 132, a second meshing board 134 and a connecting board 136 that connects the first meshing board 132 and the second meshing board 134 together. The first meshing board 132 has a pair of third slots 138. The third slots 138 in the first meshing board 132 mesh with the first slots 118 at one end of the carrier board 114. The second meshing board 134 also has a pair of fourth slots 140. The fourth slots 140 in the second meshing board 134 mesh with the second slots 124.

The corner of the protruded sections 120 close to the carrier boards 114 has a chamfer 122. When the buffering sleeves 130 mesh with the U-shaped column body 110, the connecting board 136 covers the corner chamfers 122. In addition, the end of the meshing board 134 is connected to a support plate 142. When the fourth slots 140 of the second meshing board 134 mesh with the second slots 124, the support plate 142 serves as a support between the connecting board 136 and the second meshing board 134. Hence, a gap is maintained between the two. Furthermore, the board end between the third slots 138 in the first meshing board 132 branches out to form a first plugging board 144 and a second plugging board 146. When the first meshing board 132 meshes into the carrier board 114, the first plugging board 144 is inserted into the slot 116. In the meantime, the second plugging board 146 is bent over underneath the bumper plate 112.

Figure 4:
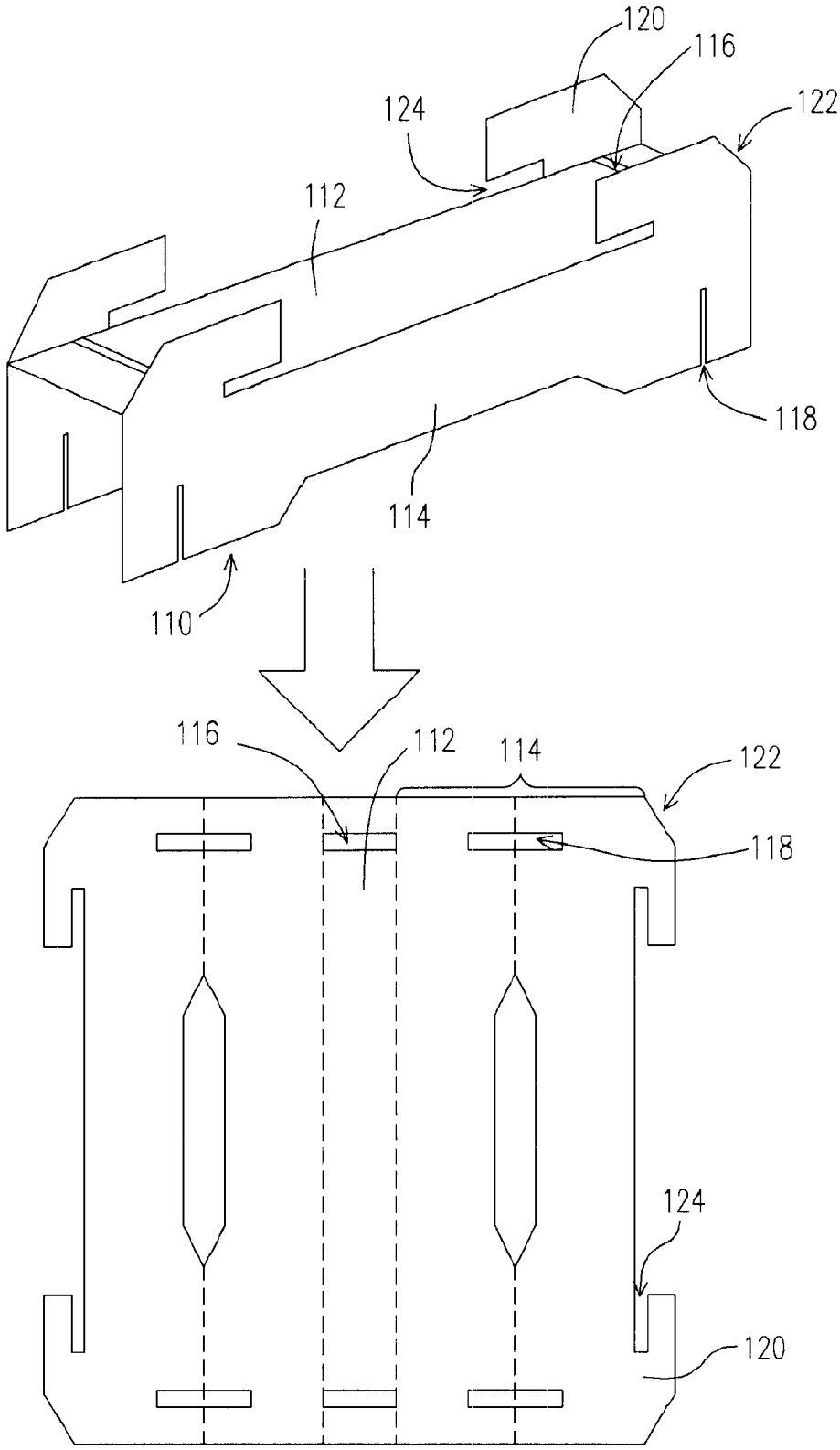
FIG. 4 is a diagram showing the flattened-out configuration of a U-shaped column body according to this invention.

FIG. 4 is a diagram showing the flattened-out configuration of a U-shaped column body according to this invention. The U-shaped column body 110 is a five-section folding board. The central section constitutes the bumper plate 112. After folding out a right angle relative to the central section, a reversing fold is carried out along the fold lines to form the carrier boards 114. The rectangular slots on the side sections form the first slots 118 in the carrier boards 114 after folding.

Figure 5:
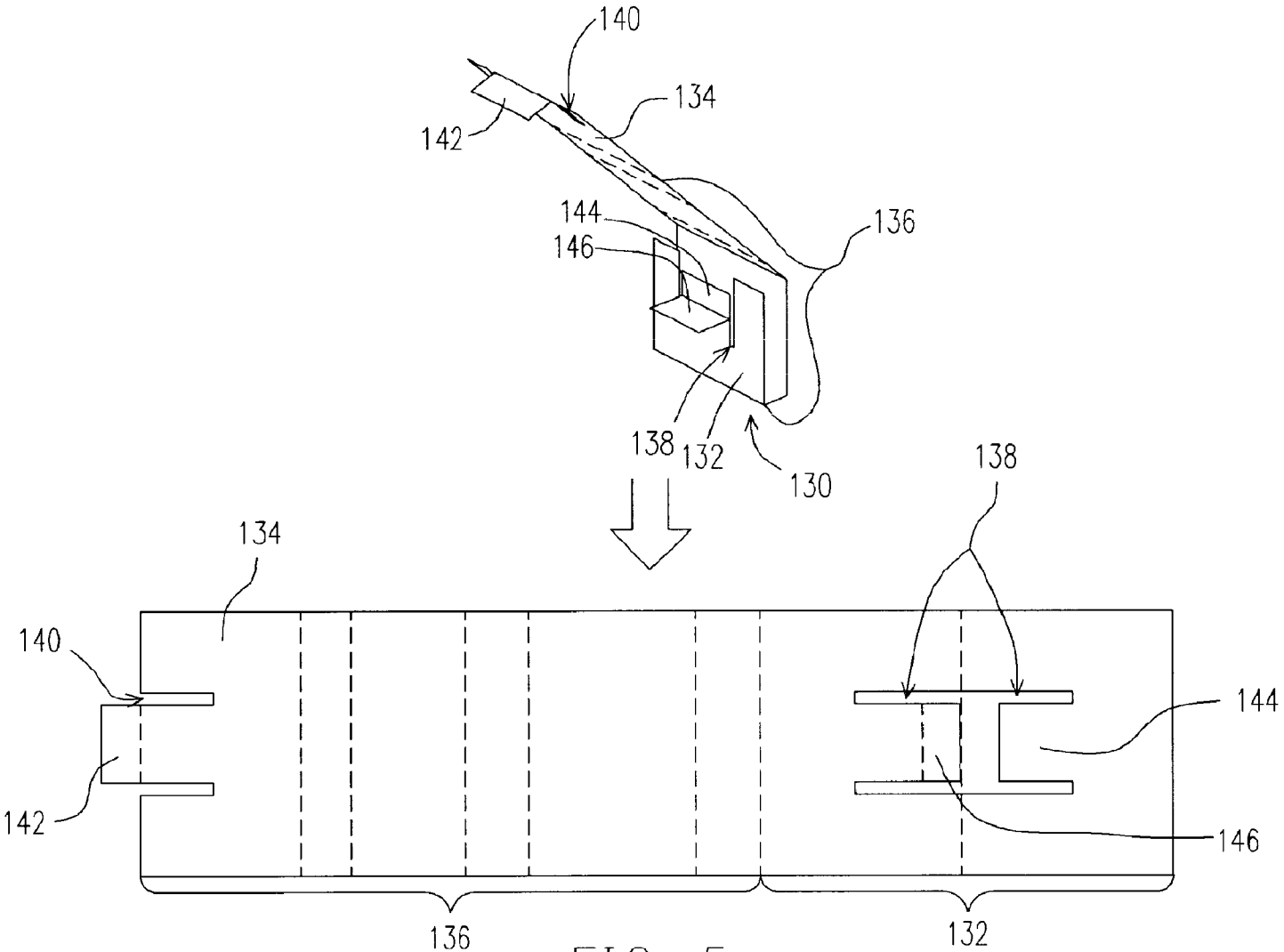
FIG. 5 is diagram showing the flattened-out configuration of a buffering sleeve according to this invention.

FIG. 5 is diagram showing the flattened-out configuration of a buffering sleeve according to this invention. The buffering sleeve 130 is formed by performing a multiple of folding operations. After folding the two fold sections on the right side together, the first meshing board 132 and associated first plugging board 144, the second plugging board 146 and the third slots 138 are formed. Thereafter, the fold sections on the left side are folded to form the second meshing board 134. The fold section on the left also connects with an extension board that forms the support plate 142.

Figure 6:
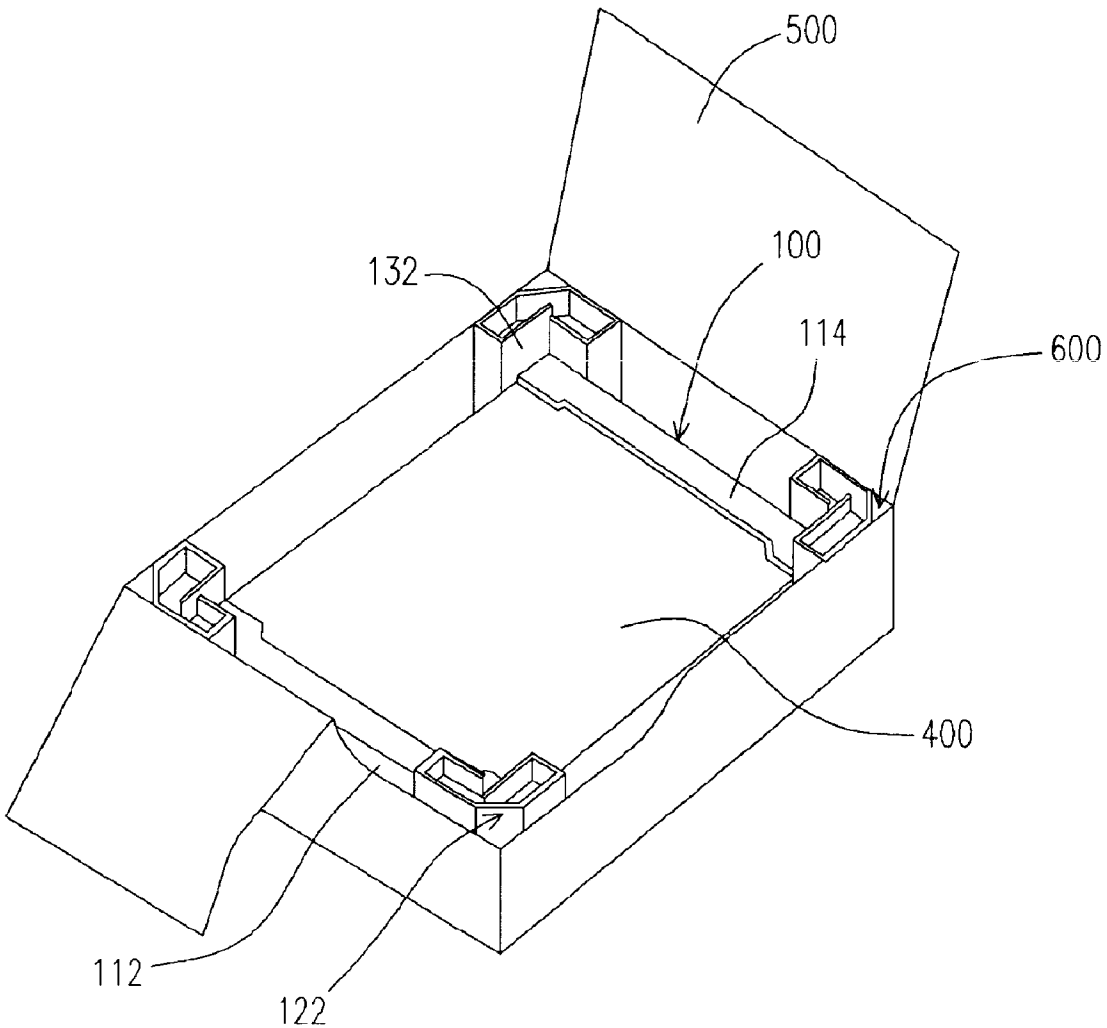
FIG. 6 is a perspective view showing a buffer packing apparatus of this invention within a packaging box.

FIG. 6 is a perspective view showing a buffer packing apparatus of this invention within a packaging box. As shown in FIG. 6, the buffer packing apparatus 100 are slid into each side of a package object (for example, a notebook computer, a compact disk player or a liquid crystal display). The entire system is lowered into a package box 500. The bumper plates 112, the first meshing boards 132 and the carrier boards 114 of the buffer packing apparatus are in contact with the package object 400. Since all the corners of the buffer packing apparatus 100 have chamfered corners 122, there is a gap 600 between the buffer packing apparatus 100 and the respective corner sections of the package box 500. Hence, damage to the object inside the package box 500 is minimized when the box 500 receives an external impact. In other words, the buffering capacity of the buffer packing apparatus 100 is increased.

In summary, the buffer packing apparatus according to this invention comprises a U-shaped column body and a pair of buffering sleeves. The U-shaped column body is form by folding a folding board. When the buffer packing apparatus is used for packing an object, the bumper plate of the U-shaped column body and the first meshing board of the buffering sleeves supports the object on all sides. Hence, the object is housed in a fixed position on a horizontal plane. In addition, the separation between the carrier boards in the U-shaped column body is made to reflect the height of the buffering object so that the object is supported in a fixed vertical position. Furthermore, the buffering sleeves on the ends of the U-shaped column body constitute the major buffering space for protecting the object against any damage resulting from an external impact. The support plate, the first plugging board and the second plugging board connected to the buffering sleeves or extending from the buffer sleeves all serve to strengthen the buffer packing apparatus. Note that all the corners of the buffer packing apparatus have chamfers. Hence, after lowering the buffer packing apparatus together with the object into a packaging box, the corner region of the buffer packing apparatus has no direct contact with the package box. When any one of the corners of the box receives an impact, the impact will not transmit directly to the buffering sleeve, thereby reinforcing the buffering capacity of the packing apparatus.

Note that this invention can accommodate any variation in the size of a package object. Through a series of minor modification of the buffer packing apparatus, the package apparatus of this invention can accommodate an object of whatever size. All that is required is, for example, simply changing the width of the bumper plate in the U-shaped column body shifting the position of the first slots on the carrier board. In short, the buffer packing apparatus of this invention provides a safe compartment for accommodating an object. The packing apparatus not only has a simple apparatus, but is also easy to fabricate and modify.

It will be apparent to those skilled in the art that various modifications and variations can be made to the apparatus of the present invention without departing from the scope or spirit of the invention. In view of the foregoing, it is intended that the present invention cover modifications and variations of this invention provided they fall within the scope of the following claims and their equivalents.

What is claimed is:

1. A buffer packing apparatus, at least comprising:

a U-shaped column body having:

a bumper plate;

a pair of carrier boards connecting with the bumper plate and the ends of each carrier board has a pair of first slots; and a pair of protruded sections connected to the ends of each carrier board being coplanar and the protruded sections extend inward from the ends of the carrier boards to form a plurality of second slots between them;

a pair of buffering sleeves, each buffering sleeve having:

a first meshing board having a pair of third slots meshing with the first slot on one end of the carrier board;

a second meshing board having a pair of fourth slots meshing with the second slots between the protruded sections and the carrier boards; and a plurality of connecting board connected to the first meshing board and the second meshing board.

2. The buffer packing apparatus of claim 1, wherein the carrier boards are set in a direction perpendicular to the bump plate.

3. The buffer packing apparatus of claim 1, wherein the corners of each protruded sections close to the two sides of the carrier board have a chamfer and that each connecting board covers the chamfer.

4. The buffer packing apparatus of claim 1, wherein the end of each second meshing board is connected to a support plate located between the connecting boards and the second meshing boards for maintaining a fixed gap between the two.

5. The buffer packing apparatus of claim 1, wherein the ends of the bumper plate in the U-shaped column body has a pair of grooves and the board end located between the third slots of each first meshing board branches out into a first plugging board and a second plugging board.

6. The buffer packing apparatus of claim 5, wherein the first plugging boards are inserted into the grooves and the second plugging boards are bent to attach to the bumper plate.

7. The buffer packing apparatus of claim 1, wherein the bumper plate, the first meshing boards and the carrier boards support are in contact with the sides of a package object when the object is packaged inside the buffer packing apparatus.

8. The buffer packing apparatus of claim 1, wherein material constituting the buffer packing apparatus is selected from a group consisting of chevron paper, board paper and paper-like material.

9. A buffer packing apparatus, at least comprising:

a U-shaped column body having:

a bumper plate with a pair of grooves at each end;

a pair of carrier boards connected in a perpendicular direction to the bumper plate, wherein the ends of each carrier board has a pair of first slots; and a pair of protruded sections connected to the ends of each carrier board so that each carrier board and corresponding protruded sections are coplanar, wherein the protruded sections extend inwards from the ends of the carrier board to form a plurality of second slots between them, and further the corners of each protruded section close to the two sides of the carrier board are chamfered;

a pair of buffering sleeves, each buffering sleeve having:

a first meshing board having a pair of third slots meshing with the first slot on one end of the carrier board, the board end between the third slots branches out to form a first plugging board and a second plugging board such that the first plugging boards are inserted into the grooves and the second plugging boards are bent to attach to the bumper plate;

a second meshing board connecting with a support plate having a pair of fourth slots meshing with the second slots between the protruded sections and the carrier boards; and a plurality of connecting board connecting the first meshing board covering the chamfered corners of each protruded section, and furthermore, the support plate on the second meshing board is positioned between the connecting boards and the second meshing boards for maintaining a fixed gap between the two.

10. The buffer packing apparatus of claim 9, wherein the bumper plate, the first meshing boards and the carrier boards support are in contact with the sides of a package object when the object is packaged inside the buffer packing apparatus.

11. The buffer packing apparatus of claim 9, wherein material constituting the buffer packing apparatus is selected from a group consisting of chevron paper, board paper and paper-like material.

* * * * *